US009383685B2

(12) United States Patent
Kitajima

(10) Patent No.: US 9,383,685 B2
(45) Date of Patent: Jul. 5, 2016

(54) DEVELOPING APPARATUS

(71) Applicant: CANON KABUSHIKI KAISHA, Tokyo (JP)

(72) Inventor: Tomoharu Kitajima, Toride (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/327,646

(22) Filed: Jul. 10, 2014

(65) Prior Publication Data

US 2015/0016837 A1 Jan. 15, 2015

(30) Foreign Application Priority Data

Jul. 10, 2013 (JP) ..... 2013-144163

(51) Int. Cl.
*G03G 15/09* (2006.01)
*G03G 15/08* (2006.01)

(52) U.S. Cl.
CPC ..... *G03G 15/0942* (2013.01); *G03G 15/0817* (2013.01)

(58) Field of Classification Search
USPC ..... 399/104
See application file for complete search history.

(56) References Cited

U.S. PATENT DOCUMENTS 5,946,530 A * 8/1999 Tsuji et al. ..... 399/103
7,369,797 B2 * 5/2008 Yoshida et al. ..... 399/256
8,170,443 B2 * 5/2012 Kawaguchi ..... G03G 15/0898 399/103
2005/0238390 A1 * 10/2005 Fukuda ..... G03G 15/0813 399/267
2008/0038021 A1 * 2/2008 Tsuda ..... G03G 15/0877 399/254
2008/0253809 A1 * 10/2008 Aimoto ..... 399/254
2011/0044719 A1 * 2/2011 Wayman ..... 399/104
2011/0229189 A1 * 9/2011 Okuno ..... 399/104
2011/0311267 A1 * 12/2011 Onishi ..... 399/104
2012/0230725 A1 * 9/2012 Sakata et al. ..... 399/111
2013/0243491 A1 * 9/2013 Nodera et al. ..... 399/260

FOREIGN PATENT DOCUMENTS

JP 11-052731 A 2/1999
JP 3267368 B2 3/2002
JP 2003-021968 A 1/2003
JP 2003-162146 A 6/2003
JP 2003-215919 A 7/2003

* cited by examiner

*Primary Examiner* — Clayton E Laballe
*Assistant Examiner* — Linda B Smith
(74) *Attorney, Agent, or Firm* — Fitzpatrick, Cella, Harper & Scinto

(57) ABSTRACT

A developing apparatus includes a developing container for accommodating a developer including magnetic particles; a developer feeding member, provided in the developing container and having a magnetic shaft, for feeding the developer; a bearing rotatably supporting the shaft; a bearing accommodating portion; and a magnet, provided around the shaft at a position inside the bearing in the bearing accommodating portion, for forming a magnetic seal of magnetic particles by a magnetic field formed between itself and the shaft. The bearing accommodating portion includes a first space between the magnet and the bearing and a second space which is provided outside of the bearing with respect to a diametrical direction and which is in fluid communication with the first space to receive the developer from the first space.

15 Claims, 6 Drawing Sheets

DEVELOPING APPARATUS

FIELD OF THE INVENTION AND RELATED ART

The present invention relates to a developing apparatus which develops an image with the use of developer having magnetic particles. In particular, it relates to the structure for a developing apparatus. More specifically, it relates to such a developing apparatus structure that forms a magnetic seal of magnetic particles, on the developing device housing side of a bearing which supports the shaft of a developer conveying member, in order to prevent developer from leaking out of the developing device housing.

An image forming apparatus, such as a copying machine, a printer, a facsimile machine, a multi functional image forming apparatus capable of performing two or more functions of the preceding image forming apparatuses, which uses an electrophotographic or electrostatic image forming method, forms an electrostatic latent image on its image bearing member, such as a photosensitive drum, and develops the electrostatic latent image into a visible image by adhering developer to the latent image. It has been known that some developing apparatuses used for developing an electrostatic latent image use two-component developer (which hereafter will be referred to simply as developer) which is made up of non-magnetic toner particles and magnetic carrier particles.

Developing apparatuses such as the above described one charge toner by stirring the toner particles while it conveys the toner particle in the housing of their developing device. More specifically, the developer in the developing device housing is stirred while being conveyed by a developer conveying member, such as a screw which has a spiral blade. The lengthwise ends of the developer conveying member are supported by a pair of bearings, one for one. Thus, as the developer conveying member is rotationally driven, the bearings are heated by the friction between the developer conveying member and bearings. Thus, it is possible that as the developer travels to the bearing, it will be melted by the frictional heat. Thus, it has been known to provide a magnetic seal between the housing and bearing of a developing device (Japanese Laid-open Patent Application 2003-215919, Japanese Laid-open Patent Application 2003-162146, Japanese Laid-open Patent Application 2003-21968, and Japanese Laid-open Patent Application H11-52731).

According to the abovementioned patent applications, magnets are disposed around the peripheral surface of the magnetic shaft. Thus, the magnetic particles of developer agglomerate in the form of a brush, between the shaft and magnets, forms thereby a magnetic seal.

However, the magnetic seal is not in contact with the shaft or magnets. Therefore, it sometimes occurs that the amount by which the developer in the developing device is made to slip by the magnetic seal, by the force by which the developer is conveyed, becomes substantial. As the developer slips by the magnetic seal by a substantial amount, the developer gradually accumulates in the space between the magnet and bearing. Eventually, the space is filled up with the developer.

Referring to FIG. 7, a bearing holding portion 303, in which a bearing 301 and a magnetic 302 are disposed, has a space 304 between the bearing 301 and magnetic 303. Normally, this space 304 is surrounded by a cylindrical supporting surface 305 which supports the bearing 301 and magnet 303.

In other words, the space 304 between the bearing 301 and magnetic 302 in terms of the direction parallel to the axial line of the bearing holding portion 303 is surrounded by the cylindrical supporting surface 305. Therefore, the space 304 is rather small. Therefore, it is likely to be filled up with the developer in an early stage of developing device usage. The bearing 301 is on the outward side of the space 304, and is heated by the heat generated by the friction between the shaft of a developer conveying member, and bearing 301. Thus, as the developer reaches the bearing 301, it will be melted by the frictional heat of the bearing. Thus, it is possible that the image forming apparatus will be stopped while the developer is still melted. Thus, it is possible that the developing device will cool down while the melted developer is between the shaft of the developer conveying member, and bearing. As the developing device cools down, the melted developer between the shaft of the developer conveying member, and the bearing, solidifies between the shaft and bearing, welding the shaft and bearing to each other. Thus, it will be rather difficult for the developer conveying member to be rotated when the image forming apparatus is started up next time.

SUMMARY OF THE INVENTION

The present invention is made in consideration of the above-described issue. Thus, its primary object is to prevent the problem that the space between the bearing and magnet is filled up by the developer having slipped by the magnetic seal, in the early stage of developing device usage.

According to an aspect of the present invention, there is provided a developing apparatus comprising a developing container for accommodating a developer including magnetic particles; a developer feeding member, provided in said developing container and having a magnetic shaft, for feeding the developer by rotation of the shaft; a bearing rotatably supporting said shaft; a bearing accommodating portion for accommodating said bearing; and a magnet, provided around said shaft at a position inside said bearing in said bearing accommodating portion, for forming a magnetic seal of magnetic particles by a magnetic field formed between itself and said shaft; wherein said bearing accommodating portion includes a first space between said magnet and said bearing and a second space which is provided outside of said bearing with respect to a diametrical direction and which is in fluid communication with said first space to receive the developer from said first space.

Further features of the present invention will become apparent from the following description of exemplary embodiments (with reference to the attached drawings).

DESCRIPTION OF THE PREFERRED EMBODIMENTS

Embodiment 1

Referring to FIGS. 1-5, the first embodiment of the present invention is described. First, referring to FIG. 1, the general structure of the image forming apparatus in this embodiment is described. The measurements, materials, and shapes of the structural components in the following embodiments of the present invention, and the positional relationship among the structural components, are not intended to limit the present invention in scope, unless specifically noted. Further, the image forming apparatuses in the following embodiments are described as an image forming apparatus which forms full-color images. It is needless to say, however, that the following embodiments are not intended to limit the present invention in scope in terms of the image forming apparatus with which the developing devices in the following embodiments are usable.

[Image Forming Apparatus]

Figure 1:
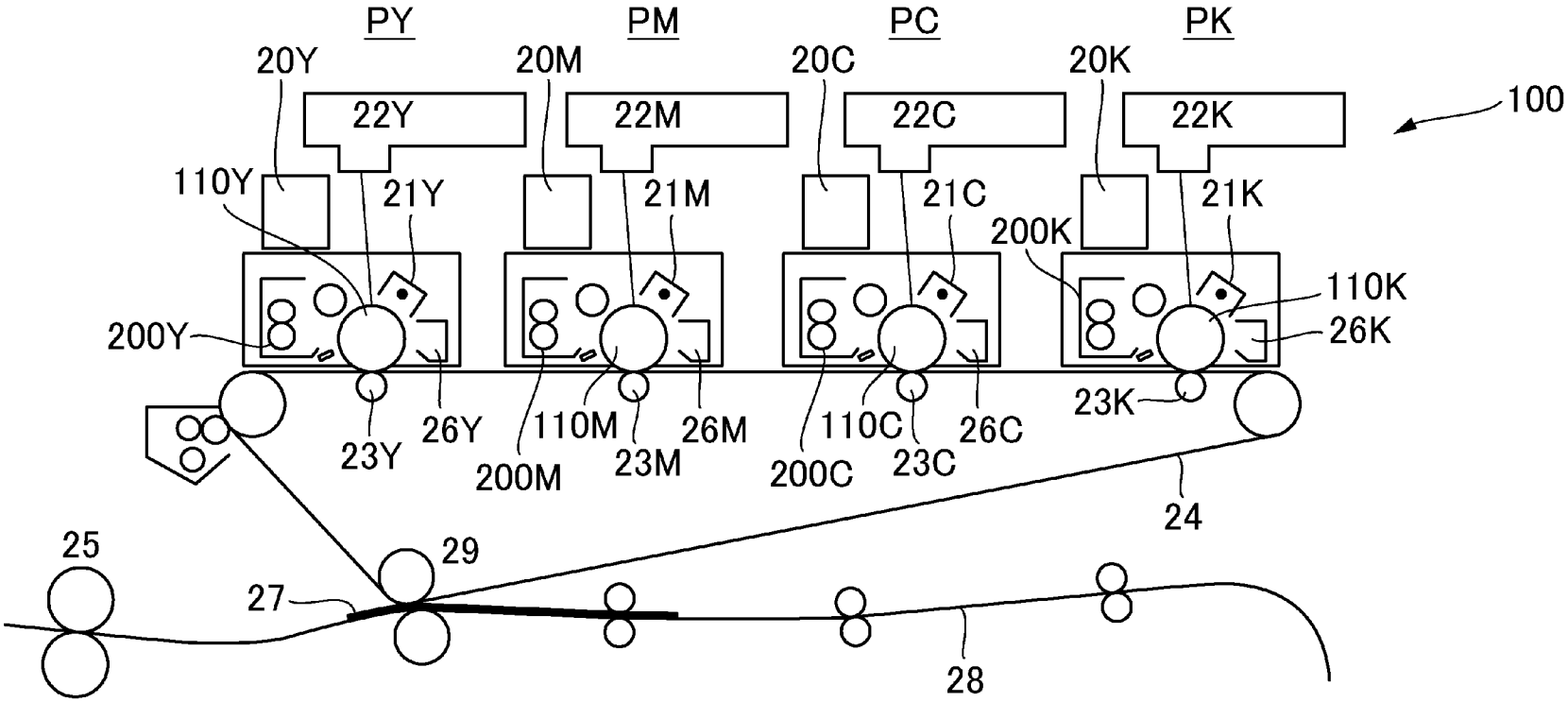
FIG. 1 is a schematic drawing of an image forming apparatus equipped with the developing device in the first embodiment of the present invention, and shows the general structure of the apparatus.

Referring to FIG. 1, the image forming apparatus 100 in this embodiment has image forming stations PY, PM, PC and PK which form yellow (Y), magenta (M), cyan (C) and black (K) images, respectively. These image forming stations PY, PM, PC and PK are aligned in tandem in the direction parallel to the rotational direction of an intermediary transfer belt 24. They are roughly the same in structure. Therefore, in the following description of the image forming apparatus, the suffixes Y, M, C and K which indicate the color of images to be formed by the image forming stations PY, PM, PC and PK, respectively, are omitted.

A photosensitive drum 110, which is an image bearing member, is rotatably disposed. Its peripheral surface is uniformly charged by a primary charging device 21. Then, an electrostatic latent image is formed on the uniformly charged portion of the peripheral surface of the photosensitive drum 110, by the exposure of the uniformly charged portion of the peripheral surface of the photosensitive drum 110 to a beam of laser light, for example, emitted by an exposing device 22 while being modulated by information signals. Then, the electrostatic latent image is developed into a visible image (toner image) by a developing device 200, on the peripheral surface of the photosensitive drum 110.

Next, the visible image (toner image) is transferred onto the intermediary transfer belt 24 by a primary transfer charging device 23. During this process of transferring, toner images, different in color, are sequentially transferred in layers onto the intermediary transfer belt 24, from the image forming stations PY, PM, PC and PK, one for one. Then, the layered toner images, different in color, on the intermediary transfer belt 24 are conveyed to a secondary transfer station 29, in which they are transferred (secondary transfer) onto a sheet 27 of recording medium, such as ordinary paper (plain paper), OHP film delivered to the secondary transfer station 29 through a recording medium conveyance passage 28. After the transfer of the toner images onto the sheet 27 of recording medium, the sheet 27 is sent to a fixing device 25, by which the images are fixed to the sheet 27. Meanwhile, the transfer residual toner, that is, the toner remaining on the peripheral surface of the photosensitive drum 110 after the primary transfer, is removed by a cleaning device 26. As the toner in the developing device 200 is consumed for development, the developing device 200 is replenished with toner from a replenishment toner container. It is not only with toner, but also, carrier that the developing device 200 is replenished.

[Developing Device]

Figure 2:
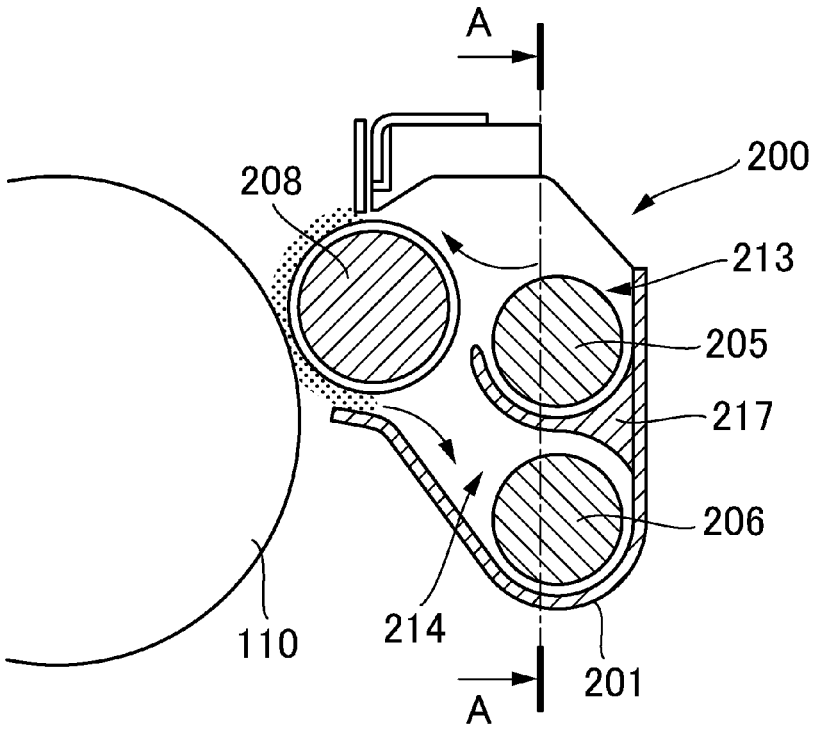
FIG. 2 is a schematic sectional view of the developing device in the first embodiment, and shows the general structure of the device.
Figure 3:
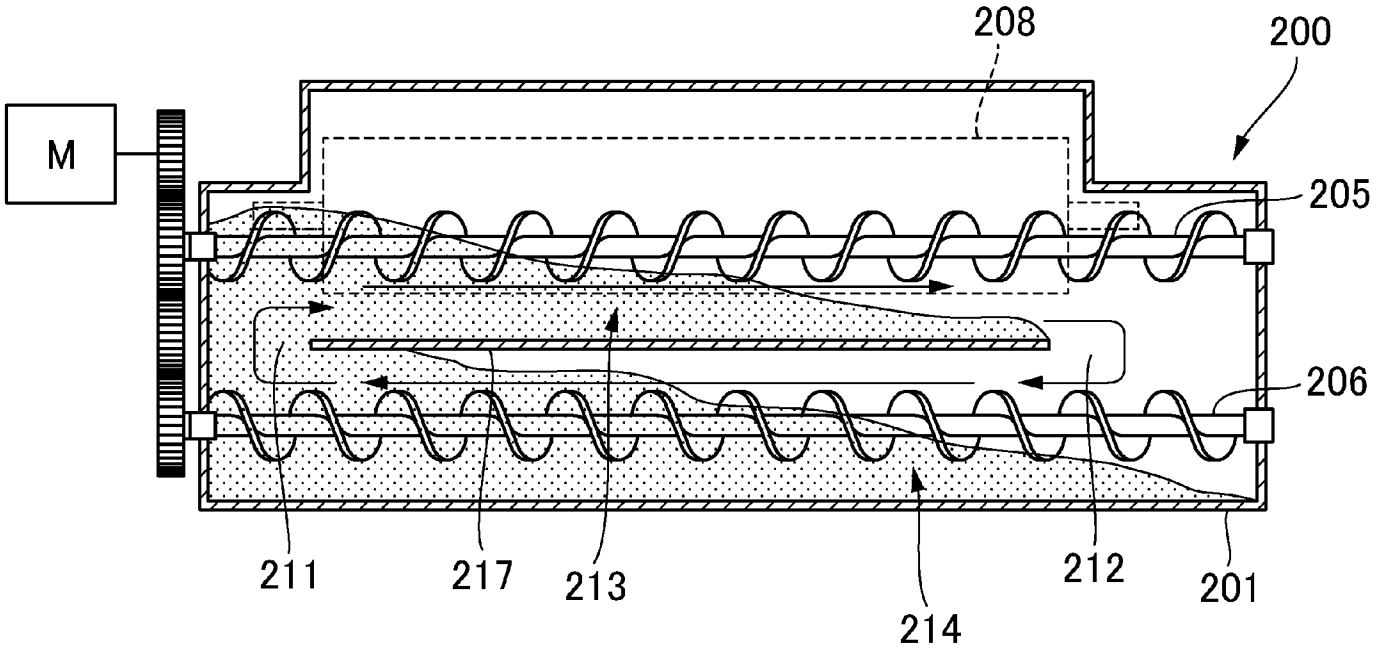
FIG. 3 is a schematic sectional view of the developing device in the first embodiment, at a plane A-A in FIG. 2.

Next, referring to FIGS. 2 and 3, the general structure of the developing device 200 in this embodiment is described. In this embodiment, two-component developer (which hereafter will be referred to simply as developer), which is a mixture of nonmagnetic toner particles and magnetic carrier particles, is used. Further, the developing device 200 in this embodiment is of the so-called vertical stir type. That is, it has two developer conveyance screws 205 and 206 as developer conveying members which convey developer while stirring the developer. The two developer conveyance screws 205 and 206 are horizontally disposed in the housing of the developing device 200, in such a manner that when the image forming apparatus 100 is in the proper attitude for image formation, the developer conveyance screw 205 is above the developer conveyance screw 206 in terms of the gravity direction.

The developing device 200 is provided with the housing 201 in which the developer is held. It is also provided with a development sleeve 208, which faces the opening of the housing 201, which faces the photosensitive drum 110. Further, the developing device 200 is provided with a development chamber 213 as the first chamber, and a stirring chamber as the second chamber 214. The developing device 200 is structured so that when the image forming apparatus 10 is in the proper attitude for image formation, the development chamber 213 and stirring chamber 214 are vertically stacked, that is, the stirring chamber 214 is on the bottom side of the development chamber 213, in terms of the gravity direction. The two chambers 213 and 214 are on the opposite side of the development sleeve 208 from the abovementioned opening of the housing 201, and are separated by a partition wall 217. Further, the developing device 200 is provided with a developer circulation passages through which the developer is circulated between the development chamber 213 and stirring chamber 214.

The first developer conveyance screw 205, as the first developer conveying member, is in the development chamber 213, and the second developer conveyance screw 206, as the second developer conveying member, is in the stirring chamber 214. Each of the first and second developer conveyance screws (which hereafter will be referred to simply as conveyance screws) has a spiral blade, and conveys developer by being rotationally driven by a motor M as a driving force source. More specifically, the first conveyance screw 205 is in the bottom portion of the development chamber 213, and extends roughly in parallel to the axial line of the development sleeve 208. It conveys the developer in the development chamber 213 (first chamber) in the direction parallel to its axial line (rightward in FIG. 3) by being rotated. As for the second conveyance screw 206, it is in the bottom portion of the stirring chamber 214, and extends roughly in parallel to the first conveyance screw 205. It conveys the developer in the stirring chamber 214 (second chamber) in the opposite direction from the developer conveyance direction of the first conveyance screw 205, (leftward in FIG. 3).

Further, the second conveyance screw 206 conveys the developer in the stirring chamber 208 is such a manner that as it conveys the developer in the stirring chamber 208 in the opposite direction from the developer conveyance direction of the first conveyance screw 205, it pushes the developer up into the development chamber 213, through a developer passage 211 which is at the left end (FIG. 3) of the developing device 200. More specifically, is, referring to FIG. 4 which will be described later, the left end of the second conveyance screw 206 is provided with a return blade 206*b*, which is angled so that as the developer in the stirring chamber 214 is conveyed to the left end of the stirring chamber 208 by the main portion of the second conveyance screw 206, the return blade 206*b* pushes the developer backward. Thus, as the developer is conveyed to the left end of the stirring chamber 208 by the second conveyance screw 206, it is pushed up into the development chamber 213 through the passage 211 as indicated by an arrow mark in FIG. 4. Meanwhile, as the developer in the development chamber 213 is conveyed to the right end (FIG. 3) of the development chamber 213, it falls into the stirring chamber 214 through the developer passage 212 which is between the development chamber 213 and stirring chamber 214. As described above, the first and second conveyance screws 205 and 206 convey the developer in the development chamber 213 and stirring chamber 214, respectively, and also, the passages 211 and 212, respectively, creating thereby a circulatory passage for the developer as indicated by an arrow mark in FIG. 3.

Further, the stirring chamber 214 is provided with an unshown replenishment toner inlet, which is on the upstream end of the stirring chamber 214 in terms of its developer conveyance direction. Thus, as the stirring chamber 214 is replenished with a fresh supply of toner by the replenishment toner container 20, the fresh supply of toner is conveyed while being stirred along with the developer which was in the stirring chamber 214. Thus, the developer in the stirring chamber 214 is made uniform in toner density. After being conveyed, while being stirred, through the stirring chamber 214, the developer is conveyed into the development chamber 213, in which it is borne by the development sleeve 203, and is conveyed by the development sleeve 208. More specifically, there is disposed a stationary magnet in the hollow of the development sleeve 208. Thus, the developer is born on the peripheral surface of the development sleeve 208 by the magnetic field generated by the magnet. Then, as the development sleeve 208 rotates about the magnet, the developer on the peripheral surface of the development sleeve 208 is conveyed to the development area, in which the development sleeve 208 opposes the photosensitive drum 110. Thus, the electrostatic latent image on the peripheral surface of the photosensitive drum 110 is developed.

As described above, the developing device 200 of the vertical stir type, shown in FIGS. 2 and 3, is structured so that its development chamber 213 is on the top side of the stirring chamber 214 in terms of the gravity direction. Therefore, it is advantageous in that it is relatively small in the amount of space it occupies in terms of the horizontal direction. Thus, it is possible to reduce in size even a color image forming apparatus of the so-called tandem type, for example, in which multiple developing devices are horizontally aligned in tandem. Further, this developing device 200, which is of the vertical stir type, has also the following advantages. That is, referring to FIGS. 2 and 3, the developer which was conveyed to the development area by being borne by the development sleeve 208, but was not used for development, is not recovered into the development chamber 213 by the rotation of the development sleeve 208. Instead, it is recovered into the stirring chamber 214. Thus, there is always present in the development chamber 213, the developer which has been fully stirred in the stirring chamber 214. Therefore, the development sleeve 208 is supplied with only the developer which is uniform in toner density, being thereby prevented from developing an electrostatic latent image into a visible image (toner image) which is nonuniform in density in terms of the direction parallel to the axial line of the development sleeve 208, and the nonuniformity of which is attributable to the insufficient stirring of the developer. That is, the developing device 200 makes it possible to obtain an image which is uniform in density.

[Bearing Holding Portion]

Figure 4:
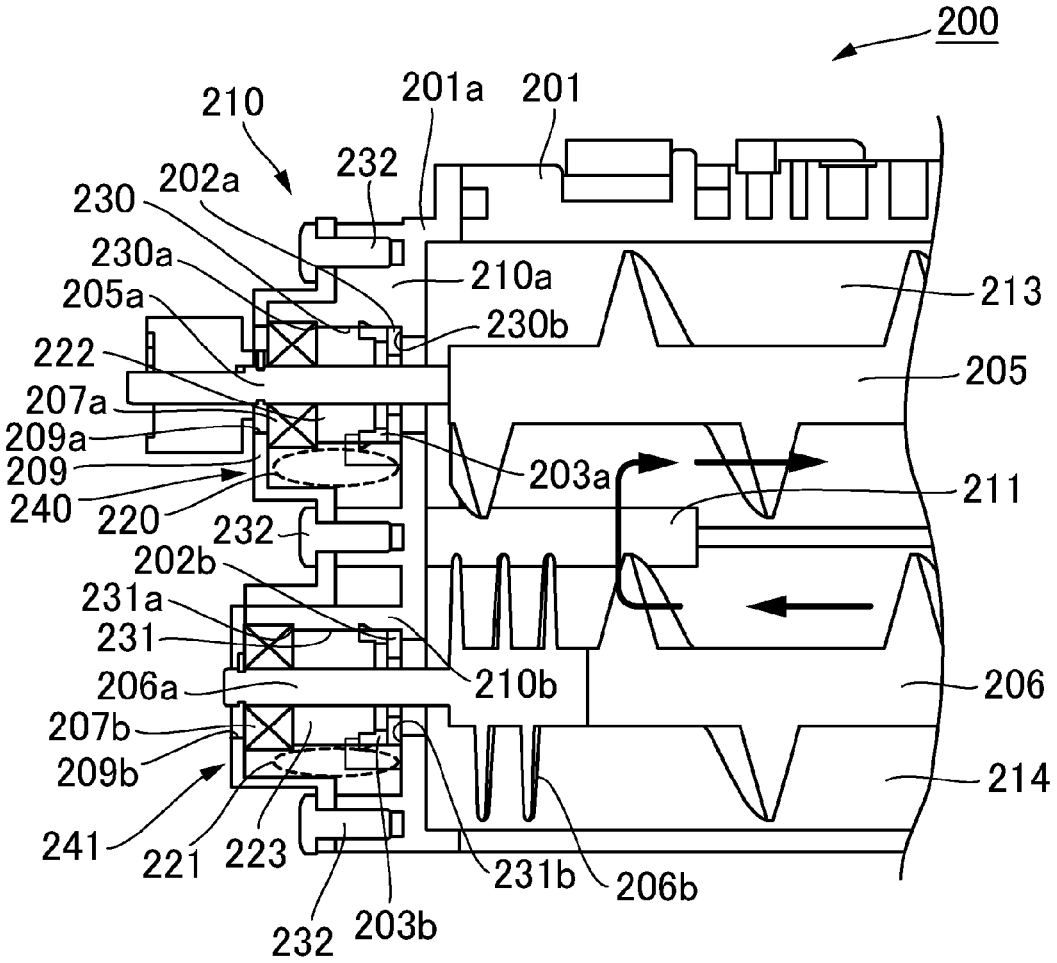
FIG. 4 is an enlarged vertical sectional view of a part of the developing device in the first embodiment.
Figure 5:
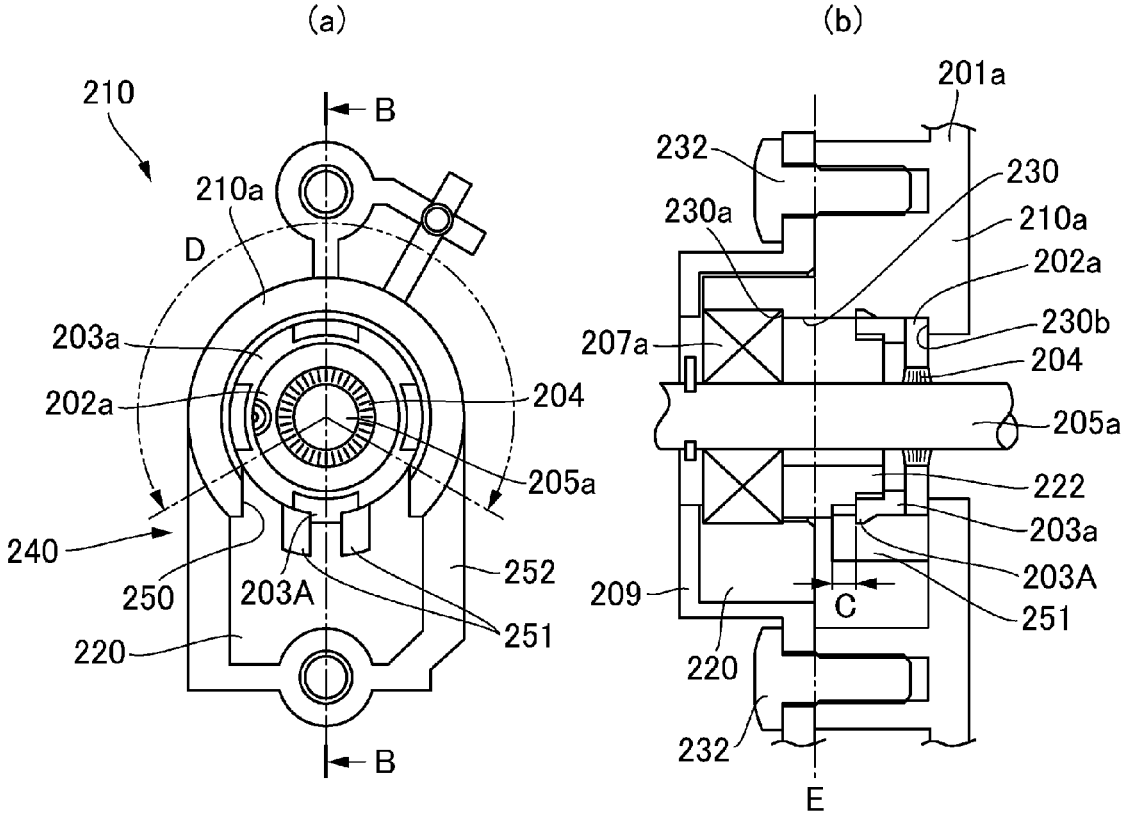
FIG. 5(*a*) is a schematic sectional view of the bearing holding portion, and its adjacencies, of the developing device in the first embodiment, and FIG. 5(*b*) is a schematic sectional view of the bearing holding portion, and its adjacencies, of the developing device in the first embodiment, at a plane B-B in FIG. 5(*a*).

Next, referring to FIGS. 4 and 5, a bearing holding portion 210, with which one of the lengthwise ends of the developing device 200 is provided, is described. By the way, FIG. 4 shows in detail only one (left one in FIG. 3) of the lengthwise ends of the developing device 200, with the omission of some portions. FIG. 5 shows top half of the bearing holding portion 210 shown in FIG. 4.

The first conveyance screw 205 has a shaft 205*a* formed of a magnetic substance. It conveys the developer by being rotated about the axial line of the shaft 205*a*. Similarly, the second conveyance screw 206 has a shaft 206*a* formed of a magnetic substance. It conveys the developer by being rotated about the axial line of the shaft 206*a*. The shafts 205*a* and 206*a* are rotatably supported by a pair of bearings 207*a* and a pair of bearings 207*b*, respectively, which are fitted in a pair of bearing holding portions 210, with which the lengthwise ends of the housing 201 of the developing device 200 is provided, one for one.

Each bearing holding portion 210 has a pair of cylindrical supporting portions 210*a* and 210*b*, and a cover 209. The cylindrical supporting portions 210*a* and 210*b* are integral parts of the wall 201*a* of the lengthwise end of developing device housing 201. The cover 209 is on the opposite side of developing device housing 201 from the pair of cylindrical supporting portions 210*a* and 210*b*. The wall portion 201*a*, cylindrical supporting portion 210*a*, and cover 209 make up the bearing holding first portion 240. The wall portion 201*a*, cylindrical supporting portion 210*b*, and cover 209 make up the bearing holding second portion 241.

The opening of the cylindrical supporting portion 210*a* of the bearing holding first portion 240, which is on the developing device housing 201 side, is in connection to the development chamber 213. It is through this opening that the shaft 205*a* of the first conveyance screw 205 in the development chamber 213 extends into the cylindrical supporting portion 210*a*. Similarly, the opening of the cylindrical supporting portion 210*b* of the second bearing holding portion 241, which is on the developing device housing 201 side, is in connection to the stirring chamber 214. It is through this opening that the shaft 206*a* of the second conveyance screw 206 in the stirring chamber 214 extends into the cylindrical supporting portion 210*b*.

The shafts 205*a* and 206*a* extend through not only the cylindrical supporting portions 210*a* and 210*b*, but also, the through holes 209*a* and 209*b* of the cover 209, in such manner that one of their lengthwise ends is exposed from the bearing holding portion 210. Thus, it is possible for driving force to be transmitted to the shafts 205*a* and 206*b* from the motor M (FIG. 3) through a gear train or the like, as described above. Incidentally, in the case of the lengthwise end of the shaft 205*a* or 206*a*, to which driving force is not transmitted from the motor M, it does not need to be extended beyond the bearing holding portion 210.

The bearings 207*a* and 207*b* are fitted in the bearing supporting portions 210*a* and 210*b* of the bearing holding portion 210, being supported by the inward surfaces 230 and 231 of the cylindrical supporting portions 210*a* and 210*b*, respectively. The shafts 205*a* and 206*a* are rotatably supported by the bearings 207*a* and 207*b*, respectively. In the case of the cylindrical supporting portions 210*a* and 210*b*, shown in the drawings, their inward surfaces 230 and 231 are provided with steps 230*a* and 231*a*, respectively. Thus, as the bearings

207*a* and 207*b* are inserted into the cylindrical supporting portions 210*a* and 210*b*, the inward ends of the peripheral portions of the bearings 207*a* and 207*b*, come into contact with the steps 230*a* and 230*b*, being thereby precisely positioned relative to the cylindrical supporting portion 210*a* and 210*b*, in terms of the direction (leftward-rightward direction in FIG. 4) parallel to the axial lines of the cylindrical supporting portions 210*a* and 210*b*, respectively. As for the cover 209, it is fixed to the wall portion 201*a* of the housing 201 with the use of multiple small screws. The left end of the bearing 207*a* (207*b*) is held by the cover 209, by its outward side in terms of its radius direction, whereby the bearings 207*a* (207*a*) is prevented from becoming disengaged from the cylindrical supporting portion 210*a* (210*b*).

Further, there are cylindrical magnets 202*a* and 202*b* in the cylindrical supporting portions 210*a* and 210*b*, being supported by the inward surfaces 230 and 231 of the cylindrical supporting portions 210*a* and 210*b*, respectively. The cylindrical magnets 202*a* and 202*b* are on the inward side (housing side) of the bearings 207*a* and 207*b* in terms of the direction parallel to the axial lines of the bearings 207*a* and 207*b*. More specifically, the magnets 202*a* and 202*b* are fitted around the magnetic shafts 205*a* and 206*a*, forming thereby a magnetic seal 204 of the carrier, which is made up of magnetic particles, by the magnetic field formed between the magnet 202*a* (202*b*) and magnetic shaft 205*a* (206*a*). The magnetic seal (magnetic brush) 204 seals the developer circulation passage by filling up the gap between the inward surface of the magnets 202*a* (202*b*) and shafts 205*a* (205*b*) by capturing the carrier particles, which are magnetic particles, with its magnetism. Thus, the developer is prevented from leaking out of the development chamber 213 and stirring chamber 214 of developing device housing 201.

In order to form the magnetic seal 204 which is uniform in properties in terms of the circumferential direction of the shaft 205*a* (206*b*), the magnet 202*a* (202*b*), and bearing 207*a* (207*b*) are concentrically disposed. That is, the magnet 202*a* (202*b*), and bearings 207*a* (207*b*) are fitted into the cylindrical supporting portion 210*a* (210*b*) so that they are supported by the inward surfaces 230 (231) of the cylindrical supporting portions 210*a* (210*b*). The portion of the inward surface 230 (231), which supports the magnet 202*a* (202*b*), and bearings 207*a* (207*b*), is processed with the use of tools which are concentrically positioned with the cylindrical supporting portion 210*a* (210*b*). Therefore, it is ensured that as the magnet 202*a* (202*b*) and bearings 207*a* (207*b*) are inserted into the cylindrical supporting portion 210*a* (210*b*), they are concentrically positioned at a high level of accuracy, by the inward surfaces 230 and 231. Therefore, a gap which is uniform in terms of the circumferential direction of the shaft 205*a* (206*b*) is formed between the shaft 205*a* (206*a*) and magnet 202*a* (202*b*).

The magnet 202*a* (202*b*) is sandwiched by the step portion 230*b* (231*b*) of the inward surface 230 (231) of the cylindrical supporting portions 210*a* (210*b*) and a magnet holding member 203*a* (203*b*), being thereby accurately positioned in terms of the direction parallel to its axial line. The magnet holding member 203*a* (203*b*) is provided with multiple (four, for example) springy claws 203A, the external diameter of which is larger than that of the cylindrical inward surface 230 (231). Therefore, as the magnet holding member 203*a* (203*b*) is inserted into the cylindrical supporting portion 210*a* (210*b*), following the inward surface 230 (231) in the direction parallel to the axial line of the cylindrical supporting portion 210*a* (210*b*), the springy claws 203A are elastically deformed inward of the cylindrical supporting portion 210*a* (210*b*) in terms of the radius direction of the cylindrical supporting portion 210*a* (210*b*), and then, snap into the recesses, one for one, with which inward surface 230 (231) is provided, becoming fixed to the inward surface 230 (231).

As will be described later, the first and second holding portion 240 and 241 of the bearing holding portion 210 are provided with developer holding portions 220 and 221, respectively, as the second spaces. Therefore, the cylindrical supporting portion 210*a* (210*b*) is provided with a gap 250 which is in connection to the developer holding portion 220 (221). By the way, FIG. 5(*a*) shows only the gap 250 of the cylindrical supporting portion 210*a* of the first holding portion 240. However, the cylindrical supporting portion 210*b* of the second holding portion 241 has also a gap similar to the gap 250 shown in FIG. 5(*a*). With the provision of cylindrical supporting portion 210*a* (210*b*) with the gap 250, the springy claw 203A of the magnet holding members 203*a* (203*b*) does not function in the area where the gap 250 is present.

Therefore, there are disposed multiple ribs 251 in the area which corresponds to the gap 250, as shown in FIG. 5(*a*), in order to ensure that the entirety of the force which can be generated by the springy claw 203A is utilized. Thus, the ribs 251 are positioned so that no matter which direction the magnet holding member 203*a* (203*b*) is rotated, the entirety of the force which can be generated by the spring claw 203 is utilized. Further, in order to prevent the ribs 251 from interfering with the discharging of the developer through the area having the gap 250, the ribs 251 are regulated in their intervals, and the distance between the rib 251 and the edge of the gap 250. For example, the minimum distance is set to 2 mm, whereas the particle size of the developer is in a range of several micrometers-several tens of micrometers.

The rib 251 is shaped so that it protrudes from the wall 201*a* of developing device housing 201 toward the shaft, and supports the magnet 202*a* (202*b*) and magnet holding member 203*a* (203*b*), by their peripheral surface. The height of the rib 251 (distance by which it protrudes from wall 201*a*) is such that after the magnet holding member 203*a* (203*b*) is pressed into the cylindrical supporting portion 210*a* (210*b*) so that the magnet 202*a* (202*b*) is pressed on the step 230*b* (231*b*), the rib 251 is greater than the springy claw 203A in terms of height from the wall 201*a*. For example, referring to FIG. 5(*b*), the rib 251 protrudes by 1.5 mm (distance C in FIG. 5(*b*)) beyond the springy claw 203A.

[Developer Holding Portion]

The bearing holding portion 210 structured as described above has the developer holding portion 220 (221) as the second space. The developer holding portion 220 (221) is in connection to the first space 222 (223) which is between the magnet 202*a* (202*b*) and bearing 207*a* (207*b*). Referring to FIG. 5, the first space 222 (223) is the space formed by the extension of the peripheral surface of the magnet 202*a* (202*b*) in the direction parallel to the axial line of the cylindrical supporting portion 210*a* (210*b*), magnet 202*a* (202*b*), and bearing 207*a* (207*b*). Therefore, it is possible for the developer in the first space to be transferred into the developer holding portion 220 (221). In this embodiment, the image forming apparatus 100 is structured so that when it is in the proper attitude for image formation, the developer holding portion 220 (221) will be on the downward side of the first space in terms of the gravity direction. Therefore, the developer in the first space 222 (223) is accepted (discharged into) the developer holding portion 220 (221) by being made to fall into the developer holding portion 220 (221) by the gravity. Further, in order to allow the developer in the first space 222 (223) to be discharged into the developer holding portion 220

(221) as described above, the cylindrical supporting portion 210*a* (210*b*) is provided with a gap such as the above described gap 250.

The gap 250 makes the width of the cylindrical supporting portion 210*a* (210*b*), in terms of its circumferential direction, less than the external diameter of the bearing 207*a* (207*b*). This means that the bearing 207*a* (207*b*), magnet holding member 203*a* (203*b*), and magnet 202*a* (202*b*) are not supported by the cylindrical supporting portion 210*a* (210*b*), by the entirety of their peripheral surface. That is, they are supported by the 180°+α (for example, 240° which is dimension D in FIG. 5(*a*)). The rest corresponds to the area through which the developer falls.

Further, the developer holding portion 220 (221) is a space with no outlet. It stores the developer as the developer falls into the developer holding portion 220 (221) from the first space 222 (223). Therefore, the cover 209 is positioned to cover the bearing 207*a* (207*b*) which is on the most outward side of the cylindrical supporting portion 210*a* (210*b*) in terms of the direction parallel to the axial line of the cylindrical supporting portion 210*a* (210*b*), as described above. Then, the cover 209 is fixed to the developing device housing 201, with the use of small screws. In other words, the cover 209 is made to double as a lid for forming the developer holding portion 220 (221). Further, referring to FIG. 5(*a*), the developer holding portion 220 (221) is surrounded by the wall 252, which is an integral part of the cylindrical supporting portion 210*a* (210*b*). In other words, the developer holding portion 220 (221) is a space (with no outlet) surrounded by the wall portion 201*a*, cover 209, and wall 252 of developing device housing 201. Providing the bearing holding portion 210 with the developer holding portion 220 (221) as described above makes it possible to increase the cylindrical supporting portion 210*a* in developer capacity to 3.3 times the first space 222, and the cylindrical supporting portion 210*b* to 2.5 times the second holding portion 241.

Further, unlike developing device housing 201, the developer holding portion 220 (221) is not subjected to the developer conveyance pressure (developer circulation pressure). Therefore, it does not require a seal. That is, no seal is placed between the adjacent components, parts thereof, etc., of which the developer holding portion 220 (221) is made up. All that was done to ensure that the developer holding portion 220 (221) remains free of developer leakage, was to make flat enough the end surface of the cylindrical supporting portion 210*a* (210*b*), and the surface E of the cover 209, by which the cover 209 is placed in contact with developing device housing 201, to allow no gap to be created in the joint between them. Thus, the mold for the cylindrical supporting portion 210*a* (210*b*) and the mode for the cover 209 can be simplified to improve the components in tolerance to make it unlikely for gaps to occur at the interface between the surface E of the cover 209 and developing device housing 201. Further, in order to ensure that the surface-to-surface contact among the above described components occurs with no gap, a minute gap (0.2 mm, for example) is provided between the cover 209 and bearing 207*a* (207*b*).

In terms of the direction in which the developing device 200 is inserted into the main assembly of the image forming apparatus, the developer holding portion 220 (221) is on the downstream side (inward side of image forming apparatus 100). The developer holding portion 220 is a part of the development chamber 213, and the developer holding portion 221 is a part of the stirring chamber 214. Referring to FIG. 3, in the case of the developing device 200 in this embodiment, the developer circulation pressure in the development chamber 213 is low on the downstream side (right side in FIG. 3), and the more upstream (left side in FIG. 3), the greater the amount of developer, being therefore higher in the developer circulation pressure, because of the manner in which the developer is circulated in the developing device 200. In this embodiment, the upstream side of the developing device 200 in terms of the developer conveyance direction corresponds to the rear side of the developing device 200. Therefore, the amount by which the developer slips by the magnetic seal 204 on the rear side of the developing device 200 is greater than on the front side. Therefore, it is desired that the developer holding portion 220 (221) is positioned on the rear side of the developing device 200.

Further, in terms of the projection drawing of developing device 200 in the direction parallel to the axial line of the cylindrical supporting portion 210*a* (210*b*), the developer holding portion 220 (221) falls within the projection of the developing device housing 201. In other words, the developing device 200 is structured so that the projection of the developer holding portion 220 (221) falls within the projection of developing device housing 201, contributing to the ease with which the developing device 200 can be inserted into, or extracted from, the main assembly of the image forming apparatus 100.

In the case of the developing device 200 in this embodiment, which is structured as described above, as the developer slips by the magnetic seal 204, it can be discharged into (accepted by) the developer holding portion 220 (221) to be accumulated in the developer holding portion 220 (221). Therefore, it is possible to prevent the problem that the space between the bearing 207*a* (207*b*) and magnet 202*a* (202*b*) is filled up with the developer having slipped by the magnetic seal 204 in the early stage of developing device usage. In other words, the presence of the developer holding portion 220 (221) makes it possible to increase the amount by which the developer is allowed to slip by the magnetic seal 204.

Figure 7:
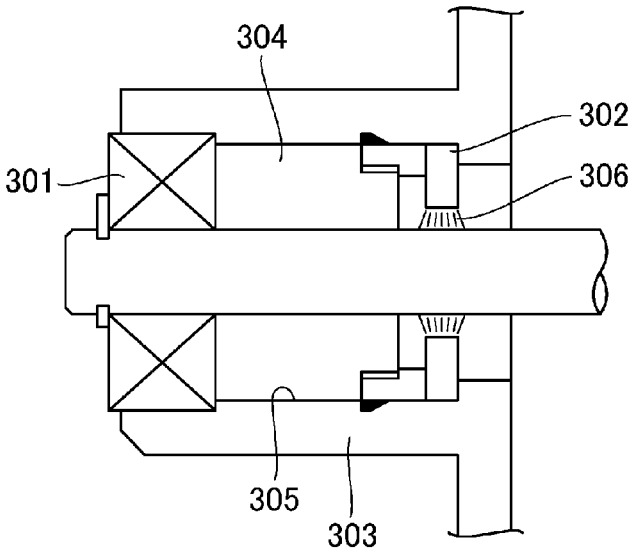
FIG. 7 is a schematic sectional view of the bearing holding portion of the comparative developing device.

Thus, it is possible to make it unlikely for the shafts 205*a* (206*a*) and bearing 207*a* (207*b*) to be welded to each other by the developer (melted developer). For example, in the case of a combination of the cylindrical supporting portion 303, bearing 301, and magnet 302 structured as shown in FIG. 7, the space between the bearing 301 and magnet 302 is relatively small. Thus, it will be filled up with the developer in the early stage of developing device usage. As the space is filled up with the developer, the developer is melted by the heat generated by the friction between the bearing 301 and shaft. Then, as the melted developer cools down, it solidly welds the bearing and shaft to each other, making sometimes it necessary for the developing device to be replaced, which in turn increases the image forming apparatus in maintenance cost. In comparison, in the case of the developing device 200 in this embodiment, it is possible to prevent the shaft and bearing from being welded to each other in the early stage of developing device usage. In other words, this embodiment can extend a developing device in the length of service life, and also, can reduce a developing device in maintenance cost.

Further, in the case of this embodiment, the developing device 200 is structured so that when the image forming apparatus 100 is in the proper attitude for image formation, the developer holding portion 220 (221) is on the bottom side of the first space 222 (223) in terms of the gravity direction, making it possible for the developer having slipped by the magnetic seal 204, to free fall into the developer holding portion 220 (221) and accumulate in the developer holding portion 220 (221). That is, the developing device 200 in this embodiment does not requires a structural means dedicated to the conveyance of the developer from the first space 222 (223) to the developer holding portion 220 (221). In other words, this embodiment can reduce a developing device (hence, image forming apparatus) in size.

By the way, it does not need to be on the underside of the first space 222 (223) in terms of the gravity direction that the developer holding portion 220 (221) is to be disposed. For example, it may be disposed at the same level as the first space 222 (223). In such a case, the developer having slipped by the magnetic seal 204 gradually spreads in the same direction as in the developer holding portion 220 (221). Therefore, it takes substantial length of time for the developer to reach the shaft. Unless the developer reaches the shaft, it does not occur that the melted developer solidifies between the bearing and shaft and interferes with the rotation of the shaft (melted developer solidifies below shaft), even if the developer is melted by the heat generated by the friction between the bearing and shaft. Further, the developing device 200 may be provided with a suctioning means dedicated to the conveyance of the developer having slipped by the magnetic seal 204. In such a case, more latitude is afforded in terms of the positioning of the developer holding portion 220 (221). For example, it may be disposed so that it is above the first space 222 (223) in terms of the gravity direction.

Further, all that is necessary is that at least the first holding portion 240 is provided with the developer holding portion 220 (221) as described above. That is, referring to FIG. 1, in the stirring chamber 214, the developer is pushed up into the development chamber 213 by the return blade 206*b*. Therefore, the second holding portion 241 is less in the amount of developer circulation pressure than the first holding portion 240. On the other hand, the development chamber 213 is subjected to the developer which is being pushed up into the development chamber 213 from the stirring chamber 214. Therefore, it becomes higher in developer circulation pressure than the stirring chamber 214. Thus, the amount by which the developer slips by the magnetic seal 204 in the second storing portion 241 is greater than that in the first storing portion 240. Therefore, it is desired that at least the first storing portion 240 is provided with the developer holding portion 220.

Embodiment 2

Figure 6:
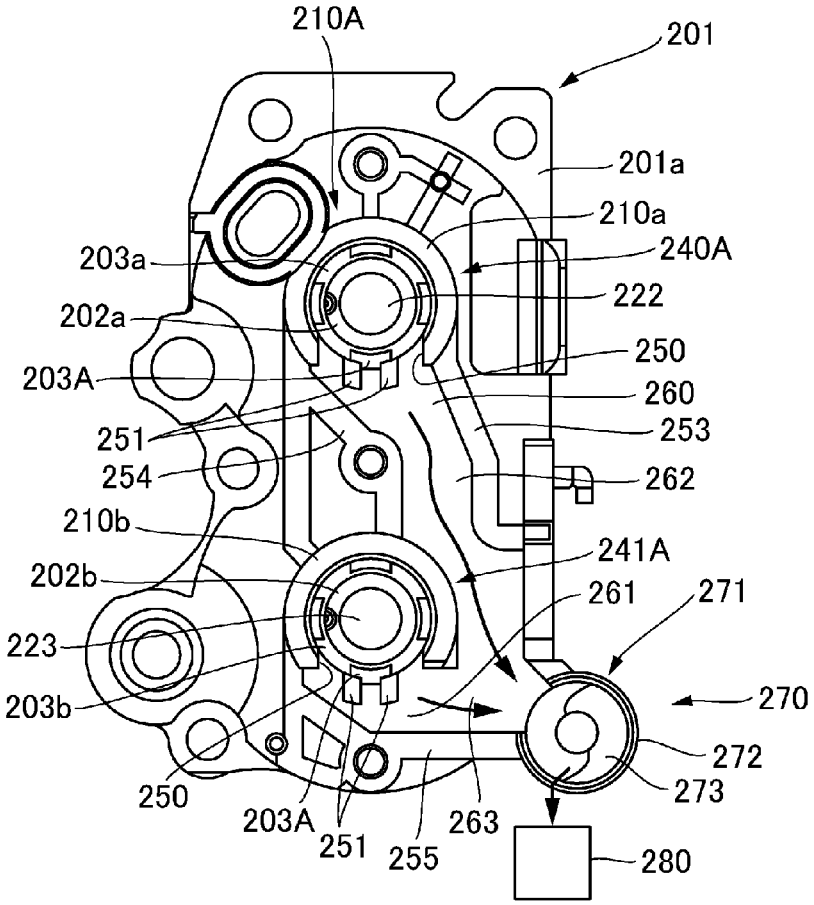
FIG. 6 is a schematic cross-sectional view of the bearing holding portion, and its adjacencies, of the developing device in the second embodiment of the present invention.

Next, referring to FIG. 6, the second embodiment of the present invention is described. In the first embodiment described above, the developer holding portion 220 (221), as the second space, was structured as a space with no outlet. In comparison, in this embodiment, the second space 260 (261), which is between the bearings 207*a* (207*b*) and magnet 202*a* (202*b*) (FIG. 4) and is in connection to the first space 222 (223), is not a space with no outlet. That is, the developing device 200 is provided with a developer recovery system 270, as a developer recovering means, which recovers the developer as the developer is received (discharged) from the first space 222 (223). The developer recovery mechanism is in connection to the second space 260 (261). Otherwise, the developing device 200 in the second embodiment is similar in structure and function to the developing device 200 in the first embodiment. Thus, its structural components, portions thereof, etc., which are the same in structure as the counterparts in the first embodiment, are given the same referential codes as those given to the counterparts, in order not to describe them, or simplify their description. That is, the description of the second embodiment will be concentrated to the difference of the developing device 200 in the second embodiment from the developing device 200 in the first embodiment.

The developing device 200 in this embodiment is structured so that when the image forming apparatus 100 is in the proper attitude for image formation, the second space 260 (261) is on the underside of the first space 222 (223) in terms of the gravity direction. The second space 260 of the first storing portion 240A, which is in connection to the development chamber 213 (FIG. 4) is between the cylindrical supporting portion 210*a* (210*b*), and the walls 253 and 254 which are next to the gap 250. In other words, the second space 260 is a space surrounded by the wall 201*a* of developing device housing 201, cover 206 (FIG. 4), and walls 253 and 254. The second space 261 of the second storing portion 241A, which is in connection to the stirring chamber 214 (FIG. 4), is formed between the bottom portion of the cylindrical supporting portion 210*b*, and the wall 255 which is an integral part of one side of the gap 250 of the cylindrical supporting portion 210*b*. That is, the second space 261 is formed by the wall 201*a*, cover 209, and the bottom portion of the first storing portion 241A. In this embodiment, the bearing holding portion 210A is made up of the first and second storing portions 240A and 241A.

The developer recovery system 270 has a recovery-conveyance portion 271, and passages 262 and 263. The developing device 200 is structured so that when the image forming apparatus is in the proper attitude for image formation, the recovery-conveyance portion 271 will be below the second space 260 (261), and conveys the developer to a recovery container 272, which is in the main assembly of the image forming apparatus 100 (FIG. 1). It is made up of a cylindrical conveyance tube 272, and a conveyance screw 273 disposed in the conveyance tube 272. The conveyance screw 273 is rotationally driven by an unshown motor, and conveys the developer in the conveyance tube 272 toward the recovery container 280.

In this embodiment, the recovery-conveyance portion 271 recovers also the developer overflow from the developing device housing 201, and conveys the developer to the recovery container 280. That is, the developing device 200 (FIGS. 2, 3, etc.) is structured so that as the developer is circulated in developing device housing 201, it is allowed to partially overflow from developing device housing 201 through the unshown opening. This structural arrangement is for discharging the old toner particles and carrier particles in developing device housing 201, that is, those which have not been used for development for a substantial length of time. As the toner in developing device housing 201 is consumed for development, the developing device housing 201 is replenished with toner from the replenishment toner container 20 (FIG. 2) as described above. That is, the developing device 200 is structured so that as the developer in the developing device housing 201 is discharged by a preset amount as described above, the developer in the developing device housing 201 is partially replaced. As the developer is discharged from the developing device housing 201, it is sent to the conveyance tube 272, and is conveyed to the recovery container 280 by the conveyance screw 273.

The developer passage 262 (263) connects the second space 260 (261) and the conveyance tube 272 of the recovery-conveyance portion 271. That is, the second space 260 is open on its downward side in terms of the gravity direction, and is in connection to the conveyance tube 272 through the passage 262, whereas the second space 261 is open on its lateral side, and is in connection to the conveyance tube 272 through the passage 263. Thus, the developer in the second space 260 of the first storing portion 240A is conveyed into the conveyance tube 272 through the passage 262, as indicated by an arrow mark in FIG. 6, whereas the developer in the second space 261 of the second storing portion 241A is conveyed to the conveyance tube 272 through the passage 263, as indicated by another arrow mark in FIG. 6.

The developer in the second space 260 conveys itself to the conveyance tube 272 by falling out of the second space 260. As for the developer in the second space 261, it is pushed into the conveyance tube 272 by the developer which is continuously discharged from the first space 223, because the conveyance tube 272 is at the same level as the second space 261. In this embodiment, the inward surface of the wall 255, which is at the bottom end of the developer passage between the second space 261 and conveyance tube 272, is tilted in such a manner that the closer it is to the conveyance tube 272, the lower in terms of the gravity direction, to ensure that the developer is smoothly conveyed from the second space 261 to the conveyance tube 272.

As described above, as the developer is conveyed from the second space 260 (261) to the conveyance tube 272, it is conveyed, along with the developer having overflowed from the developing device housing 201, to the recovery container 280 by the conveyance screw 273. In the case of this embodiment, therefore, as the developer slips by the magnetic seal 204 (FIG. 5), it can be discharged into the second space 260 (261), and then, conveyed to the recovery container 280 by the recovery-conveyance portion 271. Therefore, it is possible to prevent the problem that the space between the bearing 207*a* (207*b*) and magnet 202*a* (202*b*) is filled up with the developer having slipped by the magnetic seal 204.

In particular, in this embodiment, the developer having slipped by the magnetic seal 204 is conveyed to the recovery container 280 without being held in the developer holding portion 220 (221) as in the first embodiment. Therefore, it is possible to substantially increase the amount by which the developer is allowed to slip by the magnetic seal 204. Therefore, it is possible to prevent for a long period of time the problem that the space between the bearing 207*a* (207*b*) and magnet 202*a* (202*b*) is filled up by the developer having slipped by the magnetic seal 204.

Also in the case of this embodiment, it is not mandatory that the second space 260 (261) is positioned directly below the first space 222 (223) in terms of the gravity direction. Further, it is not mandatory that the recovery-conveyance portion 271 is positioned directly below the first space 222 (223) in terms of the gravity direction. For example, it may be positioned at a higher level than the first space 222 (223) in terms of the gravity direction. Moreover, the recovery-conveyance portion 271 may be different from the means which recovers the developer having overflowed from the developing device housing 201.

[Miscellanies]

In each of the preceding embodiments of the present invention described above, the developing device was of the so-called vertical stir type. However, the present invention is also applicable to developing devices different in structure from those in the preceding embodiments. For example, it is applicable to developing devices structured so that when the image forming apparatus is in the proper attitude for image formation, the development chamber and stirring chamber are at the same level. Further, the present invention is also applicable to developing devices which use single-component developer made up of magnetic toner.

According to the present invention, as developer slips by a magnetic seal, it is allowed to enter a second space. Therefore, it is possible to prevent the problem that the space between a bearing and a magnet is filled up by the developer having slipped by a magnetic seal in the early stage of developing device usage. Thus, it is possible to make it unlikely for the shaft and bearing are welded to each other by the developer.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-144163, filed Jul. 10, 2013 which is hereby incorporated by reference herein in its entirety.

What is claimed is:

1. A developing apparatus comprising:

a first chamber for accommodating a developer including toner and magnetic carrier;

a second chamber in fluid communication with said first chamber to establish a circulation path along which the developer circulates;

a first feeding screw for feeding the developer inside said first chamber;

a second feeding screw for feeding the developer inside said second chamber;

a first bearing, provided at one end portion side of said first feeding screw, for bearing a rotation shaft of said first feeding screw;

a second bearing, provided at one end portion side of said second feeding screw, for bearing a rotation shaft of said second feeding screw;

a first magnet provided between said first bearing and the circulation path with respect to a direction of an axis of the rotation shaft of said first feeding screw without contact with the rotation shaft of said first feeding screw to form a magnetic brush contacting a peripheral surface of the rotation shaft of said first feeding screw;

a second magnet provided between said second bearing and the circulation path with respect to a direction of an axis of the rotation shaft of said second feeding screw without contact with the rotation shaft of said second feeding screw to form a magnetic brush contacting a peripheral surface of the rotation shaft of said second feeding screw;

a first receiving portion provided between said first bearing and said first magnet and capable of receiving the developer from the circulation path, wherein the rotation shaft of said first feeding screw is provided in said first receiving portion;

a second receiving portion provided between said second bearing and said second magnet and capable of receiving the developer from the circulation path, wherein the rotation shaft of said second feeding screw is provided in said second receiving portion; and a discharging portion, in said first receiving portion or said second receiving portion, for discharging the developer from said first receiving portion or said second receiving portion to outside.

2. The apparatus according to claim 1, further comprising a communicating portion for communicating between said first chamber and said second chamber.

3. The apparatus according to claim 1, wherein said first chamber is provided above said second chamber, and said first receiving portion is provided with an open bottom portion for permitting the developer to fall by the gravity therethrough.

4. The apparatus according to claim 1, wherein said first chamber is above said second chamber and includes a first relaying portion for relaying the developer from said second chamber into said first chamber, and a second relaying portion for relaying the developer from said first chamber into said second chamber, and wherein said first magnet and said second magnet are disposed outside of said first relaying portion with respect to the direction of the axis of the rotation shaft of said first feeding screw.

5. The apparatus according to claim 1, wherein said discharging portion includes a discharging tube forming a path for discharging the developer and a discharging screw, rotatably provided in said discharging tube, for discharging the developer.

6. The apparatus according to claim 5, further comprising a supply opening for supplying the developer into a developing device for development, and a second discharge opening for discharging excessive developer in the developing device, wherein said discharging screw is capable of feeding the developer discharged through said second discharge opening.

7. The apparatus according to claim 5, wherein a center of said discharging screw is below centers of said first and second feeding screws.

8. A developing apparatus comprising:

a first chamber for accommodating a developer including toner and magnetic carrier;

a second chamber in fluid communication with said first chamber to establish a circulation path along which the developer circulates;

a first feeding screw for feeding the developer inside said first chamber;

a second feeding screw for feeding the developer inside said second chamber;

a first bearing, provided at one end portion side of said first feeding screw, for bearing a rotation shaft of said first feeding screw;

a second bearing, provided at one end portion side of said second feeding screw, for bearing a rotation shaft of said second feeding screw;

a first magnet provided between said first bearing and the circulation path with respect to a direction of an axis of the rotation shaft of said first feeding screw without contact with the rotation shaft of said first feeding screw to form a magnetic brush contacting a peripheral surface of the rotation shaft of said first feeding screw;

a second magnet provided between said second bearing and the circulation path with respect to a direction of an axis of the rotation shaft of said second feeding screw without contact with the rotation shaft of said second feeding screw to form a magnetic brush contacting a peripheral surface of the rotation shaft of said second feeding screw;

a first receiving portion provided between said first bearing and said first magnet and capable of receiving the developer from the circulation path, wherein the rotation shaft of said first feeding screw is provided in said first receiving portion;

a second receiving portion provided between said second bearing and said second magnet and capable of receiving the developer from the circulation path, wherein the rotation shaft of said second feeding screw is provided in said second receiving portion; and a discharging portion, in said first receiving portion and said second receiving portion, for discharging the developer from said first receiving portion or said second receiving portion to outside.

9. The apparatus according to claim 8, further comprising a communicating portion for communicating between said first chamber and said second chamber.

10. The apparatus according to claim 8, wherein said first chamber is provided above said second chamber, and said first receiving portion is provided with an open bottom portion for permitting the developer to fall by the gravity therethrough.

11. The apparatus according to claim 8, wherein said first chamber is above said second chamber and includes a first relaying portion for relaying the developer from said second chamber into said first chamber, and a second relaying portion for relaying the developer from said first chamber into said second chamber, and wherein said first magnet and said second magnet are disposed outside of said first relaying portion with respect to the direction of the axis of the rotation shaft of said first feeding screw.

12. The apparatus according to claim 8, wherein said discharging portion includes a discharging tube forming a path for discharging the developer and a discharging screw, rotatably provided in said discharging tube, for discharging the developer.

13. The apparatus according to claim 12, further comprising a supply opening for supplying the developer into a developing device for development, and a second discharge opening for discharging excessive developer in the developing device, wherein said discharging screw is capable of feeding the developer discharged through said second discharge opening.

14. The apparatus according to claim 12, wherein a center of said discharging screw is below centers of said first and second feeding screws.

15. A developing apparatus comprising:

a chamber for accommodating a developer including toner and magnetic carrier;

a feeding screw for feeding the developer inside said chamber;

a bearing, provided at one end portion side of said feeding screw, for bearing a rotation shaft of said feeding screw;

a magnet provided at the one end portion side of said feeding screw, without contact with the rotation shaft of said feeding screw to form a magnetic brush contacting a peripheral surface of the rotation shaft of said feeding screw;

a receiving portion provided between said bearing and said magnet and capable of receiving the developer from said chamber, wherein the rotation shaft of said feeding screw is provided in said receiving portion; and a discharging portion, in said receiving portion, for discharging the developer from said receiving portion to outside.

* * * * *